United States Patent [19]

Soliman et al.

[11] Patent Number: 5,050,674

[45] Date of Patent: Sep. 24, 1991

[54] METHOD FOR DETERMINING FRACTURE CLOSURE PRESSURE AND FRACTURE VOLUME OF A SUBSURFACE FORMATION

[75] Inventor: Mohamed Y. Soliman, Lawton, Okla.; A. Ali Daneshy, Leiden, Holland

[73] Assignee: Halliburton Company, Duncan, Okla.

[21] Appl. No.: 595,326

[22] Filed: Oct. 9, 1990

Related U.S. Application Data

[63] Continuation-in-part of Ser. No. 520,488, May 7, 1990, abandoned.

[51] Int. Cl.[5] ..... E21B 47/06; E21B 43/26

[52] U.S. Cl. ..... 166/250; 166/308; 73/155

[58] Field of Search ..... 166/250, 252, 308; 73/155

[56] References Cited

U.S. PATENT DOCUMENTS

| | | | |
|---|---|---|---|
| 4,372,380 | 2/1983 | Smith et al. | 166/250 |
| 4,660,415 | 4/1987 | Bouteca | 73/155 |
| 4,836,280 | 6/1989 | Soliman | 166/250 |
| 4,848,461 | 7/1989 | Lee | 166/250 |

OTHER PUBLICATIONS

"Microfrac Tests Optimize Frac Jobs" *Oil & Gas Journal*, pp. 45–49 (Jan. 22, 1990) Kuhlman.

SPE 8341 . . . Determination of Fracture Parameters from Fracturing Pressure Decline . . . Nolte, Sep. 1979.

SPE 15370 . . . Technique for Considering Fluid Compressibility and Temperature Changes in Mini-Frac Analysis . . . Soliman, Oct. 1986.

SPE 13872 . . . Pressure Decline Analysis with the Christianovich and Zheltov and Penny-Shaped Geometry Model of Fracturing . . . Lee, May 1985.

*Primary Examiner*—George A. Suchfield

*Attorney, Agent, or Firm*—Robert A. Kent

[57] ABSTRACT

In one aspect of the present invention, a method is provided for determining the fracture closure pressure of a fractured formation. The method includes the steps of injecting a fracturing fluid into a subsurface formation to create a fracture, measuring the pressure response of the formation after injection has ceased, and determining the pressure at the onset of constant volume behavior as the fracture closure pressure. In another embodiment of the present invention, the fracture volume, leak-off volume and efficiency are determined by integrating the fracture closure rate over time, and then iterating with a fluid volume equation. Still another embodiment of the present invention determines the fracture volume, leak-off volume and efficiency by extrapolating the apparent system volume back to the moment when injection is stopped.

10 Claims, 7 Drawing Sheets

Figure 1 - Treating Pressure vs Time

METHOD FOR DETERMINING FRACTURE CLOSURE PRESSURE AND FRACTURE VOLUME OF A SUBSURFACE FORMATION

CROSS REFERENCE TO RELATED APPLICATION

The present application is a continuation-in-part of U.S. application Ser. No. 520,488 filed May 7, 1990, now abandoned.

BACKGROUND OF THE INVENTION

1. Field of the Invention

The present invention relates generally to improved methods for determining fracture characteristics of subsurface formations, and more specifically relates to improved methods for utilizing test fracture operations and analyses, commonly known as "microfrac" and "minifrac" operations, to determine fracture closure pressure and fracture volume.

2. Description of the Related Art

It is common in the industry by hydraulically fracture a subsurface formation in order to improve well production. The industry has developed several test to aid the design of a hydraulic fracture treatment. Two such tests are known as the "minifrac" and the microfrac".

A minifrac operation consists of performing small scale fracturing operations utilizing a small quantity of fluid to create a test fracture. The fractured formation is then monitored by pressure measurements. Minifrac operations are normally performed using little or no proppant in the fracturing fluid. After the fracturing fluid is injected and the formation is fractured, the well is typically shut-in and the pressure decline of the fluid in the newly formed fracture is observed as a function of time. The data thus obtained is used to determine parameters for designing the full scale formation fracturing treatment. Conducting minifrac tests before performing the full scale treatment generally results in improved fracture treatment design, and enhanced production and improved economics from the fracture formation.

Minifrac test operations are significantly different from conventional full scale fracturing operations. For example, as discussed above, only a small amount of fracturing fluid is injected, and no proppant is typically utilized. The fracturing fluid used for the minifrac test is normally the same type of fluid that will be used for the full scale treatment. The desired result is not a propped fracture of practical value, but a small fracture to facilitate collection of pressure data from which formation and fracture parameters can be estimated. The pressure decline data is utilized to calculate the effective fluid loss coefficient of the fracture fluid, fracture width, fracture length, efficiency of the fracture fluid, and the fracture closure time. These parameters are then typically utilized in a fracture design simulator to establish parameters for performing a full scale fracturing operation.

Similarly, microfrac tests consist of performing very small scale fracturing operations utilizing a small quantity of fracturing fluid without proppant to create a test fracture. Typically, one to five barrels of fracturing fluid are injected into the subsurface formation at an injection rate between two and twenty gallons per minute. The injection rate and fracturing fluid volume necessary to initiate and propagate a fracture for ten to twenty feet depend upon the subsurface formation, formation fluids and fracturing fluid properties. The main purpose of a microfrac test is to measure the minimum principal stress of the formation. See Kuhlman, *Microfrac Test Optimize Frac Jobs,* Oil & Gas Journal, 45–49 (Jan. 22, 1990), the entire disclosure of which is incorporated by reference herein.

The mechanics behind the minifrac and the microfrac tests are essentially the same. Fracturing fluid is injected into the formation until fracture occurs. After a sufficiently long fracture is created, the injection of fluid is typically stopped and the well is shut-in (pump-in/shut-in test) or the fracturing fluid is allowed to flow-back at a prescribed rate (pump-in/flow-back test). The newly created fracture begins to close upon itself since fluid injection has ceased. In both the pump-in/shut-in test and the pump-in/flow-back test pressure versus time data are acquired. The pressure that is measured may be bottom hole pressure, surface pressure, or the pressure at any location in between. Fracture theory predicts that the fluid pressure at the instant of fracture closure is a measure of the minimum principal stress of the formation. This is especially true when the injected fluid volume and injection rate are small (compared to the volume and rate of a conventional fracture treatment).

The present invention is directed to an improved method of determining the fracture closure pressure and fracture volume of a fractured subsurface formation. Conventional methods of determining fracture closure pressure have relied on the identification of an inflection point in the pressure versus time data. See Nolte, *Determination of Fracture Parameters From Fracturing Pressure Decline,* SPE 8341 (1979), the entire disclosure of which is incorporated herein by reference. Experience has shown, however, that identifiable inflection points are only found for pump-in/flow-back type fracturing tests and even then only when the flow-back rate has been optimized, i.e., not too low a flow-back rate nor too high a flow-back rate. Moreover, the identification of an inflection point in the data, which may or may not exist depending on testing parameters, finds little theoretical support as a true indication of fracture closure pressure (minimum principal stress).

Accordingly, the present invention provides a new method for determining the fracture closure pressure and fracture volume of a subsurface formation utilizing either a microfrac operation or a minifrac operation regardless of whether the test parameters are pump-in/flow-back or pump-in/shut-in.

SUMMARY OF THE INVENTION

In one aspect of the present invention, a method is provided for determining the fracture closure pressure of a fractured formation. The method includes the steps of injecting a fracturing fluid into a subsurface formation to create a fracture, measuring the pressure response of the formation after injection has ceased, and determining the pressure at the onset of constant volume behavior as the fracture closure pressure. In another embodiment of the present invention, the fracture volume, leak-off volume and efficiency are determined by integrating the fracture closure rate over time, the then iterating with a fluid volume equation. Still another embodiment of the present invention determines the fracture volume, leak-off volume and efficiency by extrapolating the apparent system volume back to the moment when injection is stopped.

DETAILED DESCRIPTION OF A PREFERRED EMBODIMENT

Figure 1:
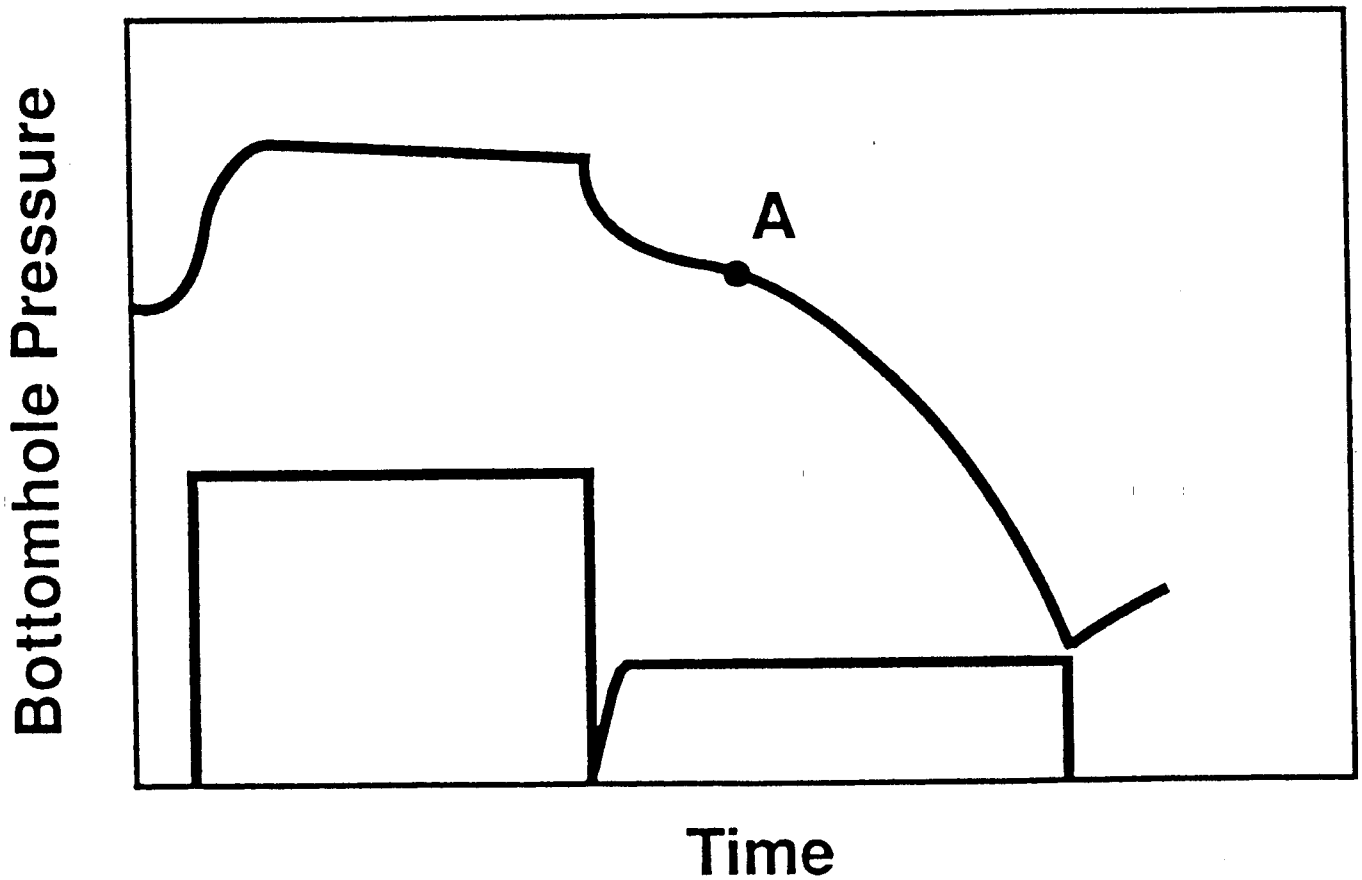
FIG. 1 is a representation of bottom-hole pressure versus time data for a pump-in/flow-back microfrac test that exhibits an injection point.

FIG. 1 shows pressure-time data for a pump-in/flow-back fracture test which evidences an inflection point (A). Conventional techniques, such as that described by Nolte, equate the pressure at inflection point A as the fracture closure pressure. However, experience reveals that few pump-in/flow-back fracture tests and virtually no pump-in/shut-in tests exhibit an identifiable inflection point. For example, the pressure-time data of FIG. 2 exhibit straight line behavior (A-B) after the early initial curvature.

Figure 2:
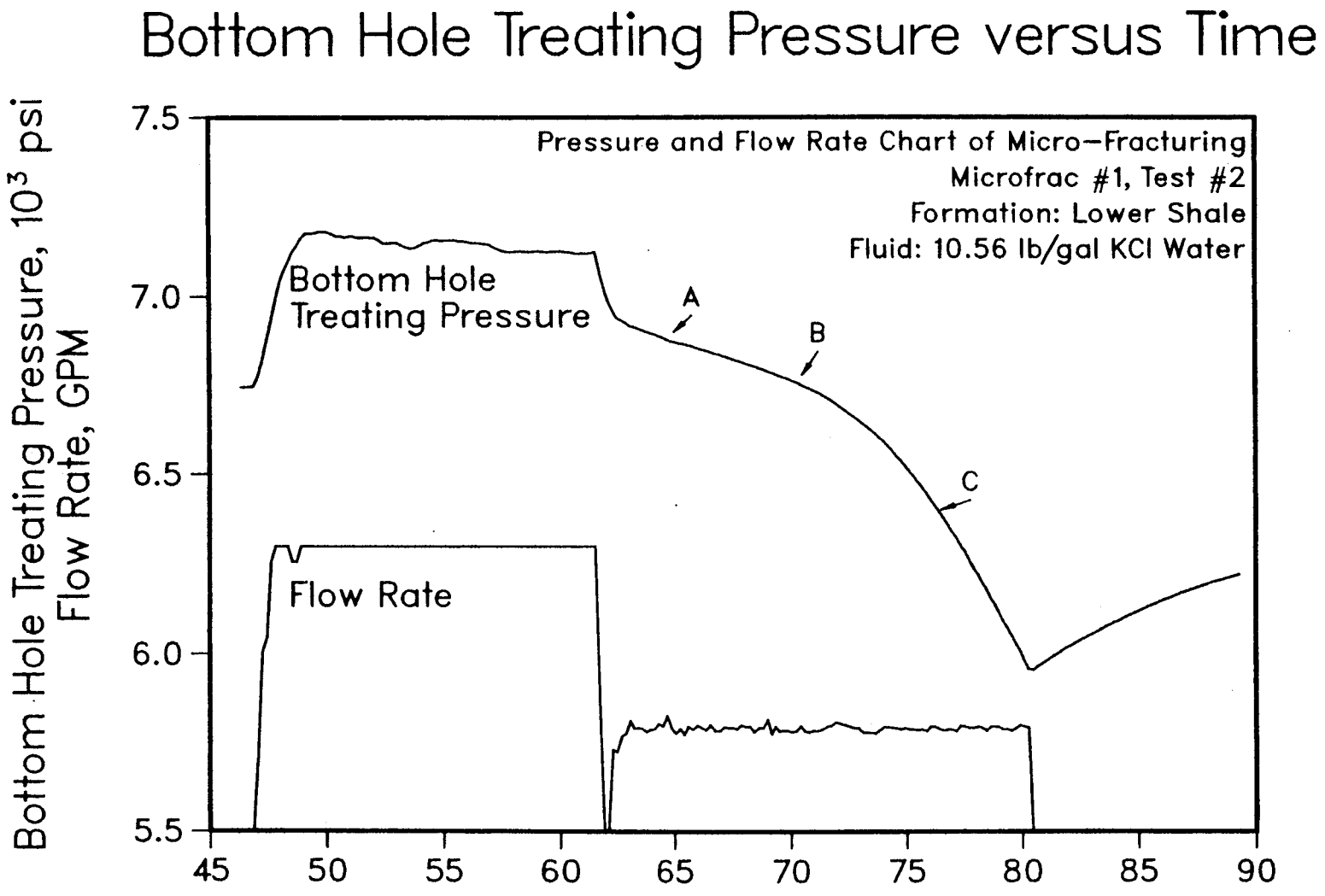
FIG. 2 shows bottom-hole pressure versus time for a pump-in/flow-back microfrac test that does not exhibit an inflection point.

The data represented in FIG. 2 were obtained from a typical pump-in/flow-back microfrac test is which both the injection rate and the flow-back rate were held constant. This specific fracture test was run in a shale formation and therefore it was expected that the leak-off rate would be extremely low. Consequently, it was also expected that the pressure drop during the flow-back period would be proportional only to the flow-back rate. However, this was found not to be the case.

Fracture closure begins at the cessation of fluid injection. During fracture closure, the flow-back rate is somewhat compensated by the continuous decrease in fracture volume, the contraction of the well bore, and the expansion of the fracture fluid. Thus, the system volume is not a constant. After the fracture closes, however, the decline in pressure is expected to be linearly proportional to the flow-back rate.

The data in FIG. 2 exhibit a decline in the rate pressure change with time that stabilizes forming a straight line. Finally, the rate of pressure change increases again only to joint a steeper straight line. Since flow-back rate was maintained fairly constant, the reason for this unexpected behavior is attributed to the mechanism of fracture closure during the flow-back period.

The sharp decline in pressure that occurs early is probably due to fluid stabilization combined with some fracture growth. During injection, the fracturing fluid does not reach the tip of the newly formed fracture leaving a dry area. A pressure gradient will also exist within the fracturing fluid. As soon as injection stops, the fluid will be redistributed to accommodate the new conditions. Consequently, some fluid may move into the previously dry area which in turn will force some further fracture propagation. This combined effect will cause pressure to decline rapidly. After this initial sharp decline, fluid leak-off, fluid flow-back, fluid expansion and fracture closure (reduction in volume) will cause a stable, slow decline in pressure. When the fracture begins to close (as shown later, closure may begin at the fracture tip) the pressure decline will accelerate.

When the fracture completely closes, pressure will decline very rapidly. For a specific flow-back rate, the rate of decline of pressure with time depends on ability of formation of produce fluid. In the case of a shale formation, the formation is incapable of producing enough fluid to significantly offset the flow-back rate. Consequently, pressure declines linearly with time according to the simple compressibility equation:.

$$C = -\frac{1}{V}\frac{dV}{dP} \qquad \text{EQN. 1}$$

where

C=fluid compressibility factor, in 2/lb

V=system flow-back or wellbore volume, gal.

P=system pressure, psia dV/dP=rate of change of system volume with respect to pressure, gal/psi Equation 1 may be rearranged as shown in Equations 2 and 3:

$$dV = -CV\,dP \qquad \text{EQN. 2}$$

$$\frac{dV}{dt} = -CV\frac{dP}{dt} \qquad \text{EQN. 3}$$

wherein t=time, min.

Figure 3:
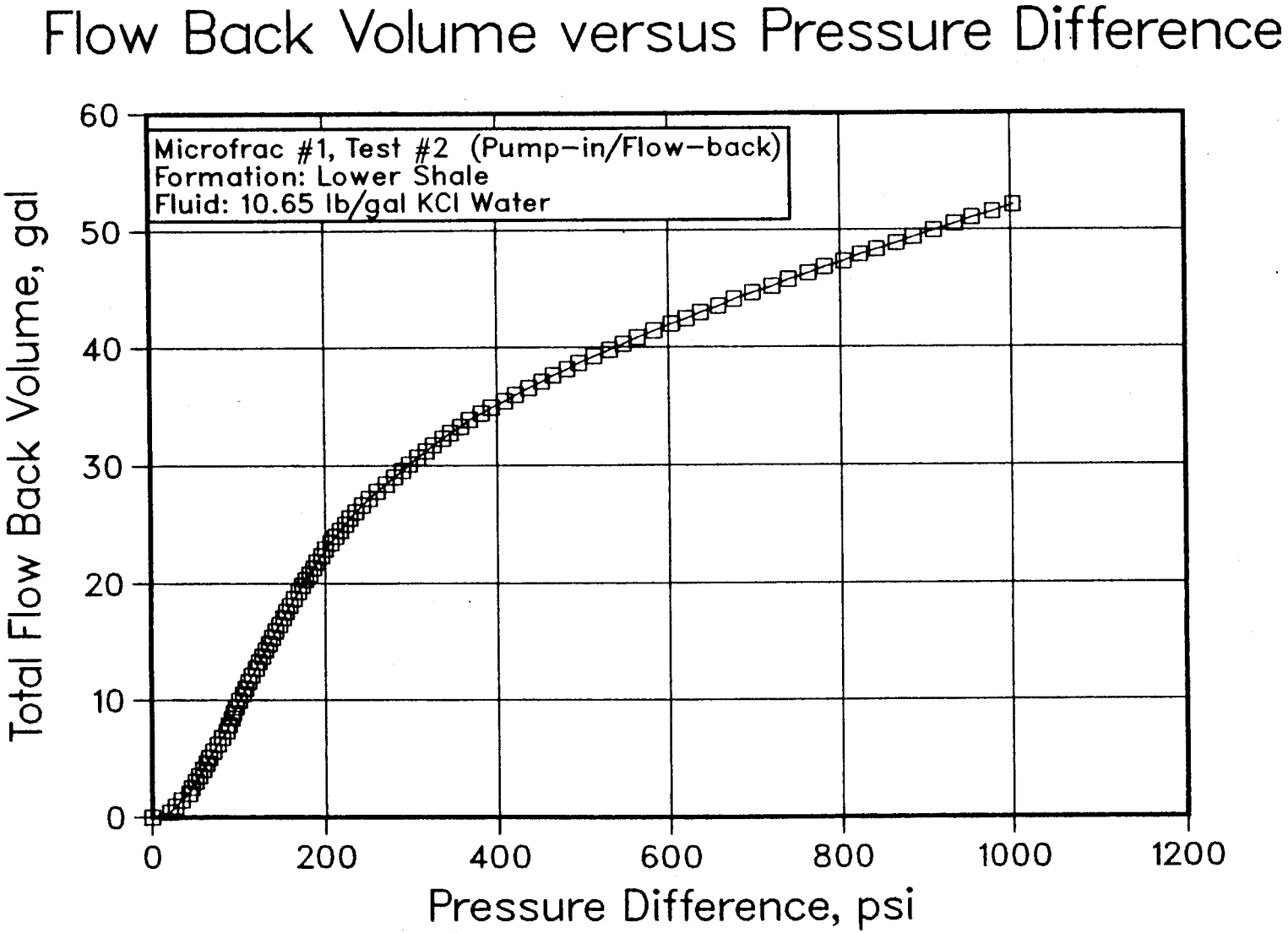
FIG. 3 shows total flow-back volume ($V_{fB}$) versus pressure difference (dP) data for the microfrac test shown in FIG. 2.

Equation 2 indicates that plotting total flow-back volume (dV) versus corresponding change in pressure (dP) yields a straight line of slope equal to CV. FIG. 3 shows a plot of total flow-back volume versus change in pressure for the data represented in FIG. 2. FIG. 3 shows that the data generally follow a curve, and finally join a straight line. The early part of the curve indicates the period during which fracture starts closure, i.e., when the volume is changing. The straight line portion of the curve indicates that the data follow Equation 1, thereby signifying a constant volume behavior and fracture closure. Variants of equations 2 and 3 may be used to reach the same conclusion.

Thus, according to the present invention, the pressure at the occurrence of straight line behavior, i.e., constant volume, is taken as the instant of fracture closure. In FIG. 3, the fracture closure pressure is found to be approximately 650 psi less than the pressure at shut-in (ISIP).

Equation 1 may also be rewritten as:

$$-\frac{1}{C}\frac{dV}{dP} = V \qquad \text{EQN. 4}$$

$$-\frac{1}{C}\frac{dV/dt}{dP/dt} = V \qquad \text{EQN. 5}$$

Figure 4:
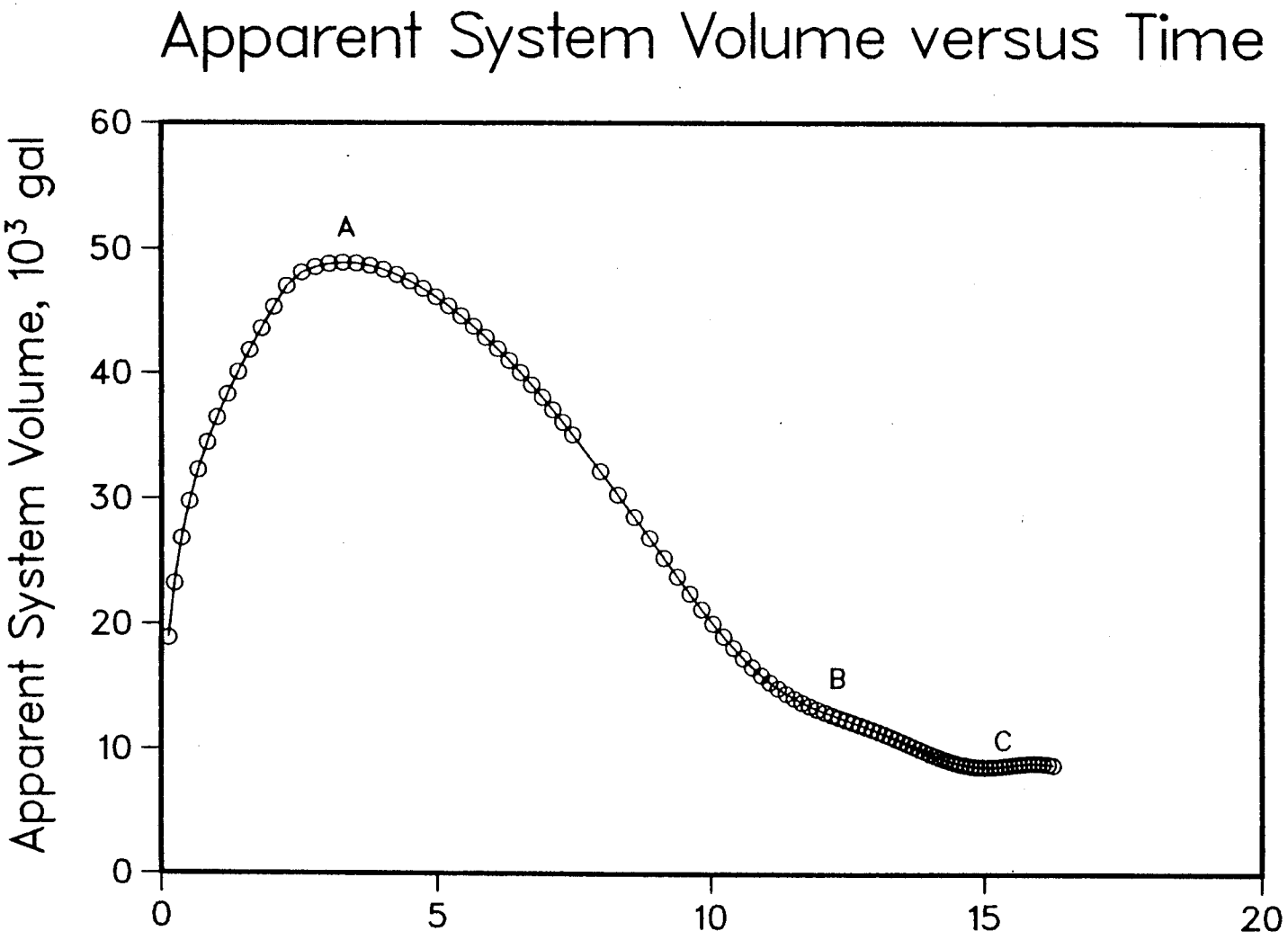
FIG. 4 shows apparent system volume (V) versus time data for the microfrac test shown in FIG. 2.

FIG. 4 shows the data given in FIG. 3 plotted according to Equation 4. The ordinant axis has been labelled apparent system volume, which is defined as the volume a system following compressibility Equation 1 would have in order to produce the observed pressure decline for the imposed flow-back rate. Note that the apparent system volume does not consider the leak-off of fluid into the formation because leak-off is assumed to be negligible. The leak-off volume must be considered when leak-off is non-negligible. It is seen that FIG. 4 indicates a large apparent fracture volume that reaches a maximum of 49,000 gallons and eventually declines to a constant value of 8,000 gallons. The constant volume of 8,000 gallons agrees very well with the known well configuration for this data. Reaching a constant volume indicates complete closure of the fracture.

The analysis above may be further explained using FIGS. 2 and 4. FIG. 2 shows the early pressure drop due to fluid stabilization that ends at point A. This effect is reflected in FIG. 4 as quick increase in apparent system volume reaching a maximum at point A, corresponding to point A in FIG. 2. Between point A and B in FIGS. 2 and 4, the fracture begins to close. This behavior is shown as a gradual decline in system volume. At point B, the rate of fracture closure suddenly slows down as evidenced by a sharp break in FIG. 4. Starting at point B on FIG. 2, the pressure decline with time accelerates. This phenomenon may indicate actual tip closure and fracture length may be decreasing with time. At point C in FIGS. 2 and 4, the fracture is completely closed as evidence by the constant system volume in FIG. 4. The pressure at point C is considered, in accordance with the present invention, to be the minimum principal stress of the formation. FIG. 4 also presents a justification for choosing point B as the point of start of fracture closure.

The straight line behavior exhibited in FIG. 2, following fracture closure does not necessarily means that no fluid is leaking into the formation. It only means that the flow-back rate is the majority of fluid leaving the system. This is similar to the wellbore storage concept in well test analysis.

During the injection period, fluid leaks into the formation building a fluid back around the fracture. Pressure gradients inside this fluid bank depend on fluid properties and formation permeability. Pressure in this fluid bank approaches that the fluid inside the fracture. During the flow-back period, fluid starts flowing from the fluid bank into the fracture. Thus, the dissipation of the fluid bank will be in the direction of both the reservoir and the fracture. When the flow-back period ends, flow from the reservoir (fluid bank) into the fracture will continue causing a pressure increase as can be seen in FIG. 2. The increase in pressure depends on, among other things, formation and fluid properties, total fluid injected into the formation, and rate and length of flow-back period.

In a well designed microfrac test (pump-in/flow-back), the pressure increase after flow-back ends should not exceed point C. However, if the injection rate and injected volume are high, it is possible that this pressure may exceed point C (minimum principal stress).

Additionally, the present invention allows fracture volume to be obtained from the curve of apparent system volume versus flow back time by extrapolating the curve back to zero time. But because of the small fracture volume involved in a microfrac test, the uncertainty in the fracture volume determination may be quite large. The present invention also allows fracture volume to be obtained by integrating the rate of fracture closure over time. If fracturing fluid leak-off is neglected than Equation 6 may be used to calculate rate of fracture closure:

$$q_{fc} = 1 - \left(\frac{V_w}{V}\right) q_{fb} \qquad \text{EQN. 6}$$

where $q_{fc}$=Rate of fracture closure, gal/min $V_w$=wellbore volume, gal.

V=apparent system volume, gal.

$q_{fb}$=system flow-back rate, gal/min

Figure 5:
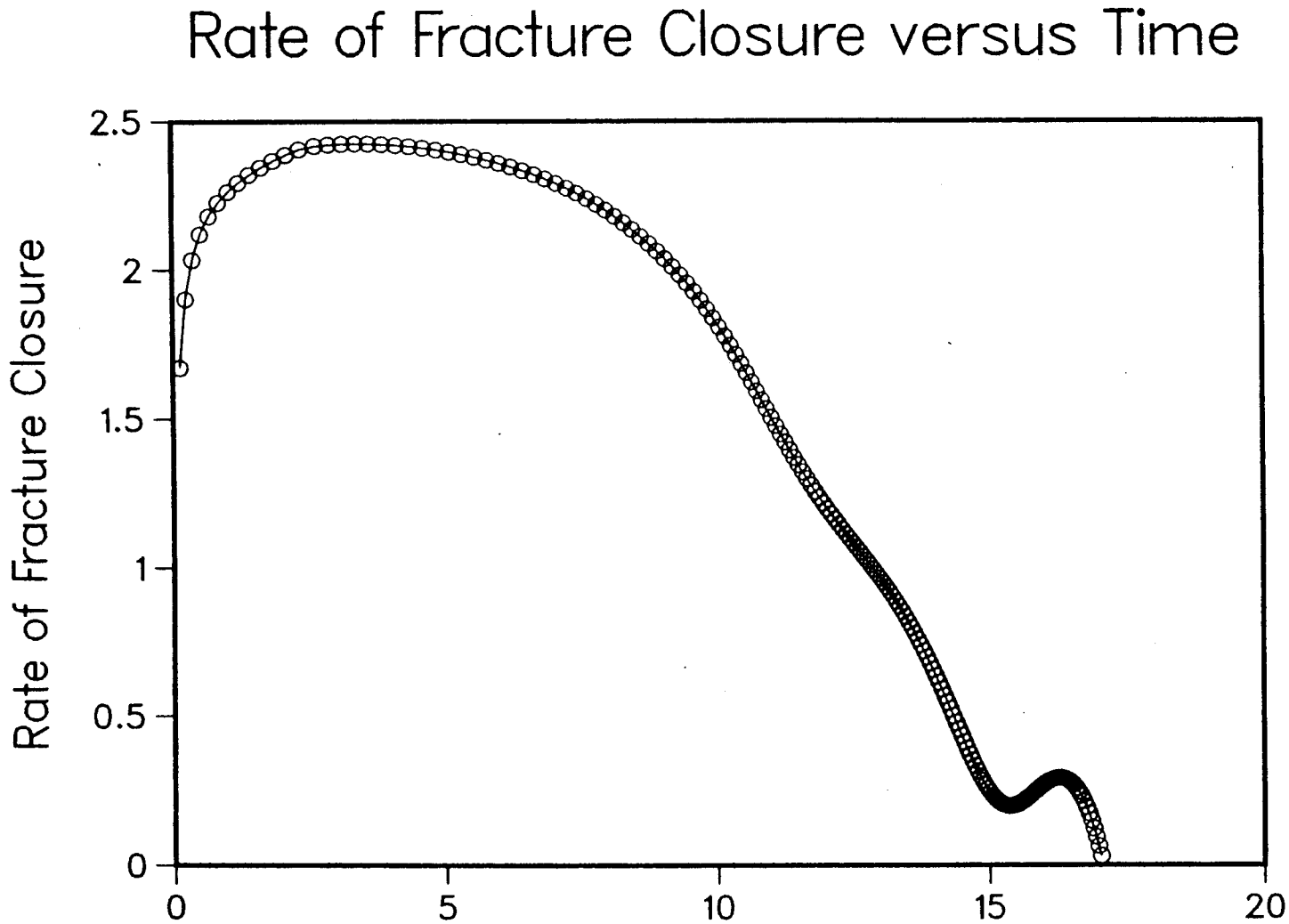
FIG. 5 shows rate of fracture closure ($q_{fb}$) versus flow-back time for the microfrac data in FIG. 2.

FIG. 5 shows the rate of fracture closure against time. Assuming negligible leak-off, the integration of the rate of fracture closure over flow-back time will yield fracture volume. However, even in a shale formation leak-off is typically significant. Total system volume, including leak-off volume, must satisfy a material balance equation of the form:

$$V_f = V_{fb} + V_{LO} - V_{fE} \qquad \text{EQN. 7}$$

where $V_f$=fracture volume at beginning of flow-back, gal.

$V_{fB}$=total flow-back volume, gal.

$V_{LO}$=total fluid leaked into formation, gal.

$V_{fE}$=fluid expansion during flow-back, gal.

Except for leak-off volume $V_{LO}$, all parameters in Equation 7 are either measured, e.g., total flow-back volume, or are calculated independently. Consequently, one may use Equation 7 to calculate leak-off volume.

To illustrate the method of the present invention the data of FIG. 2 is utilized to calculate a fracture volume and total leak-off. The apparent system or fracture volume is calculated using Equation 4 or 5 and may be plotted as in FIG. 4. Assuming that no leak-off is taking place, Equation 5 may be utilized to determine the fracture closure with time through integration. The area under the curve is the fracture volume. Equation 7, however, considers leak-off into the formation. If leak-off was actually negligible, the $V_{Lo}$ would have been equal to zero. A fracture volume of 28.7 gallons and a leak-off of 6.2 gallons were calculated. By calculating a leak-off volume larger than zero it is indicated that Equations 5 and 6 should be modified to include this effect. At this point it is necessary to assume a leak-off rate. If the leak-off rate is assumed to be constant with time, then the leak-off rate is determined by simply dividing the total leak-off volume by the closure time (other functions such as decline of rate as a function of $\sqrt{t}$ may be assumed). The system flow back rate ($q_{fb}$) then is modified (increased by this amount) such that the flow back rate now includes both flow-back and leak-off and a new fracture volume and leak-off volume are calculated using modified Equations 6 and 7. This iterative technique will finally converge yielding a leak-off volume and fracture volume. By iterating between Equations 6 and 7, the fracture volume was established as 38.12 gallons while the total leak-off during flow-back was estimated as 16.3 gallons.

Thus, out of the 90 gallons injected during the injection stage, 51.88 gallons leaked into the formation yielding an efficiency of only 42.35%. This fluid efficiency appears to be very low considering that the microfrac was created in a shale. A longer treatment (hours instead of minutes), however, could have produced the expected high efficiency.

The method for determining fracture closure pressure and fracture volume is applicable to conventional microfrac tests, as shown, and also to minifrac operations. Table 1 and 2 below give the analysis of the data reported in FIG. 2 using a modified minifrac technique. The specific calculations are based upon use of the Penny or Radial model which is well known to those individuals skilled in the art. It is to be understood that the Perkins and Kern or Christianovich-Zheltov models also could be utilized with similar results being obtained. A general discussion of the models is set forth in SPE/DOE 13872 (1985) entitled *Pressure Decline Analysis With The Christianovich and Zheltov and Penny-Shaped Geometry Model Of Fracturing,* the entire disclosure of which is incorporated herein by reference. If the closure pressure is chosen as has been discussed (point C, FIG. 2), a fluid efficiency of 61.6% is calculated (Table 1). If the effect of fluid compressibility as discussed in *Techniques For Considering Fluid Compressibility And Fluid Changes in Minifrac Analysis,* SPE 15370 (1986) by Soliman is considered, then an efficiency of 41% would result. The entire disclosure of SPE 15370 is incorporated herein by reference. This value agrees very well with the value calculated using the technique presented earlier in the test.

For contrast, if the end of the first straight line segment (point B, FIG. 2) is taken as the fracture closure pressure, then an efficiency of 38% is calculated (Table 2). Considering the effect of compressibility would yield an efficiency of 24%. This value is much lower than what was calculated earlier and will lead to erroneous conclusions.

TABLE 1

| TABLE 1 OUTPUT FROM ESTIMATING FRACTURING PARAMETERS (EFP) PROGRAM MINIFRAC ANALYSIS USING CLOSURE TIME OPTION | | |
|---|---|---|
| INPUT DATA | | |
| PUMPING RATE | .2 | (BBL/MIN) |
| PUMPING TIME | 14.9 | (MIN) |
| TIME AT ISIP | 15.1 | (MIN) |
| ISIP | 6973.0 | (PSI) |
| CLOSURE PRESSURE | 6409.0 | (PSI) |
| FLOWBACK RATE | .1 | (BBL/MIN) |
| YOUNG'S MODULUS | 0.400E + 08 | (PSI) |
| M PRIME | 1.00 | |
| K PRIME | .00300 | |
| PENNY MODEL | | |
| CREATED RADIUS | 47.4 | (FT) |
| FLUID LOSS COEFFICIENT | .000075 | (FT/MIN ** ½) |
| AVERAGE WIDTH | .01652 | (IN) |
| FLUID EFFICIENCY | 61.6 | (I) |
| CLOSURE | 14.4 | (MIN) |

TABLE 2

| OUTPUT FROM ESTIMATING FRACTURING PARAMETERS (EFP) PROGRAM MINIFRAC ANALYSIS USING CLOSURE TIME OPTION | | |
|---|---|---|
| INPUT DATA | | |
| PUMPING RATE | .2 | (BBL/MIN) |
| PUMPING TIME | 14.9 | (MIN) |
| TIME AT ISIP | 15.1 | (MIN) |
| ISIP | 6973.0 | (PSI) |
| CLOSURE PRESSURE | 6805.0 | (PSI) |
| FLOWBACK RATE | .1 | (BBL/MIN) |
| YOUNG'S MODULUS | 0.400E + 08 | (PSI) |
| M PRIME | 1.00 | |
| K PRIME | .00300 | |
| PENNY MODEL | | |
| CREATED RADIUS | 36.8 | (FT) |
| FLUID LOSS COEFFICIENT | .000202 | (FT/MIN ** ½) |
| AVERAGE WIDTH | .01694 | (IN) |
| FLUID EFFICIENCY | 38.0 | (I) |
| CLOSURE TIME | 6.4 | (MIN) |

Figure 6:
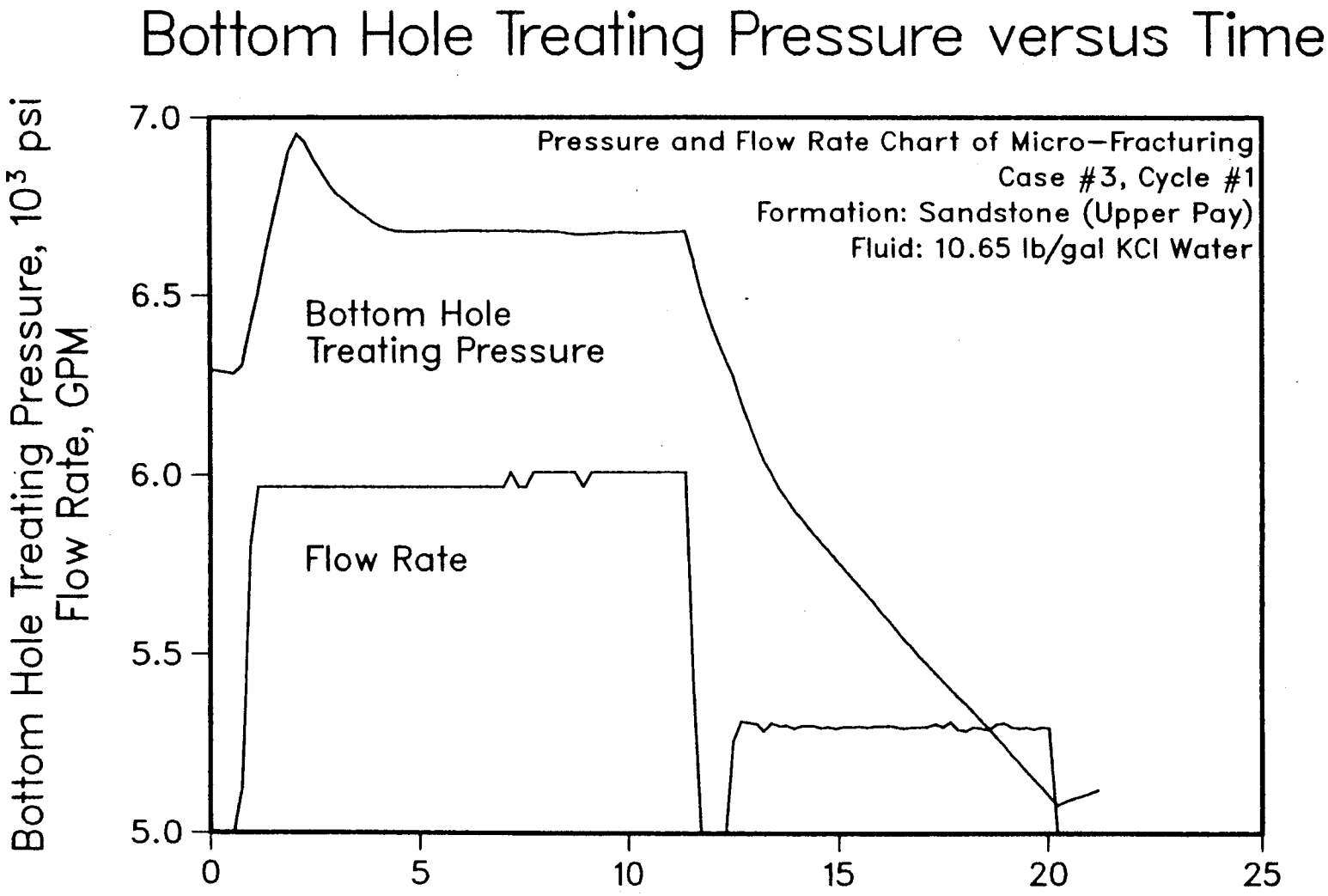
FIG. 6 shows bottom-hole pressure versus time data for a pump-in/flow-back microfrac test in a high leak-off formation.
Figure 7:
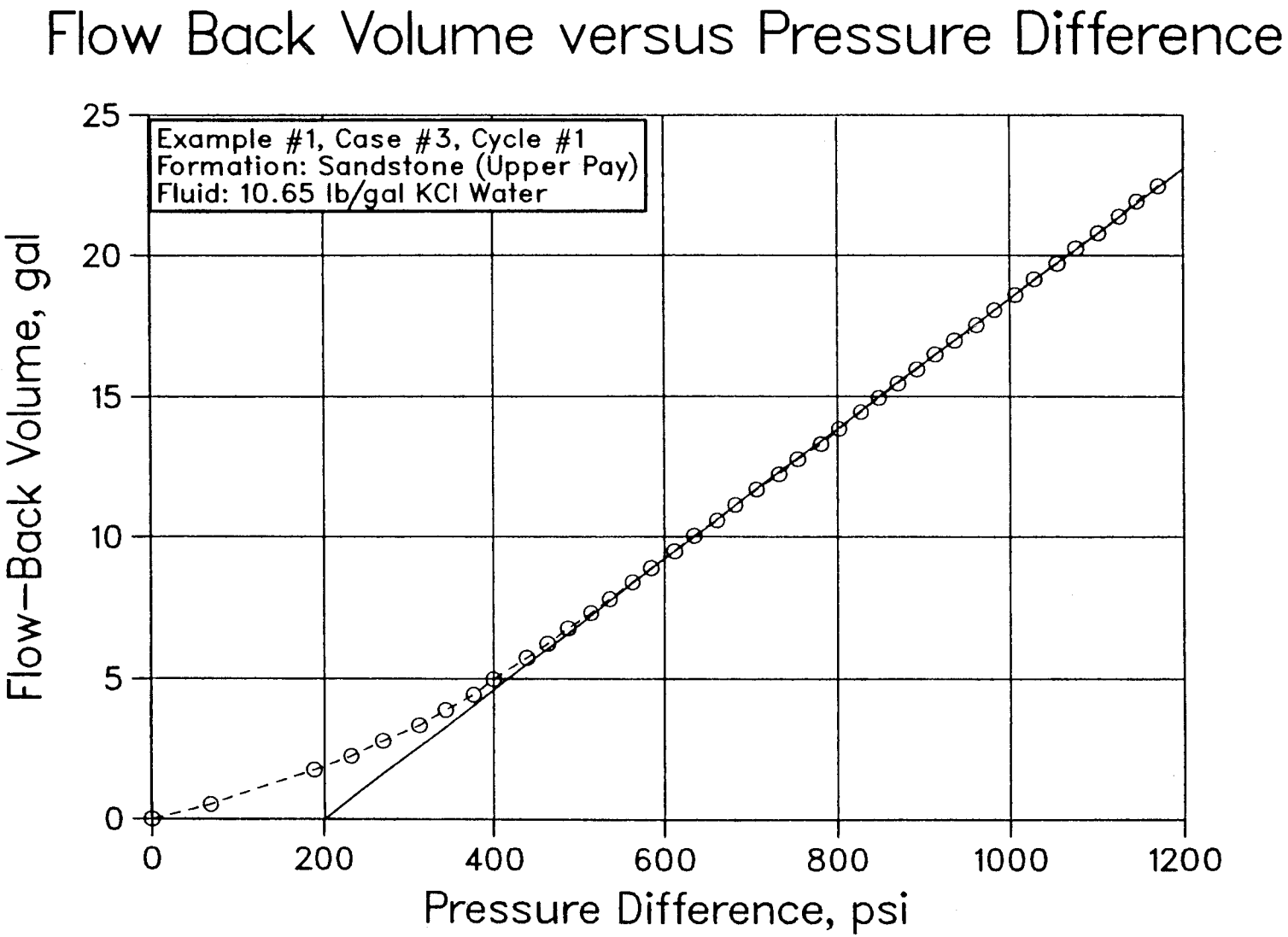
FIG. 7 shows total flow-back volume ($V_{fB}$) versus pressure difference (dP) data for a pump-in/flow-back microfrac test in a high leak-off formation.

The foregoing discussion considered a shale formation where leak-off during the flow-back period was minimal. However, the present invention is applicable to high leak-off formations as well. Pump-in/flow-back data for a sandstone formation is given in FIG. 6. The data are plotted in FIG. 7 in a manner similar to the data in FIG. 3. It is apparent from comparing FIG. 3 and FIG. 7 that curve shape is affected by the amount of fluid leak-off. Closure pressure may be obtained from the data in FIG. 6 as it was determined from the data in FIG. 2. However, because leak-off is significant, the pressure data obtained from the fracture test is analyzed using conventional techniques known in the art to estimate leak-off coefficient and fracture length. The leak-off rate into the formation can then be estimated from the leak-off coefficient as is well known. Integration of the leak-off rate will yield total leak-off volume ($V_{LO}$) as a function of time. The leak-off volume is combined with the flow-back volume and used to estimate the total flow-back volume (or apparent system volume). Total flow-back volume can then be plotted against pressure difference as shown in FIG. 3. At this point, the method for determining the fracture closure pressure and pressure volume proceeds as described above. The same procedure may be applied to pump-in/shut-in tests. Because fracture closure pressure may change with the volume of fluid injected into the formation, the outlined procedure preferably should be applied to every test. The use of closure pressure from a microfrac test to analyze a subsequent minifrac test is not recommended.

What is claimed is:

1. A method of determining characteristics of a fracture subterranean formation comprising the steps of:
   (a) injecting fluid into a wellbore penetrating said subterranean formation to generate a fracture in said formation;
   (b) measuring pressure of the fluid over time after injection of said fluid has ceased; and
   (c) determining fracture closure pressure at onset of constant volume behavior of the said pressure and time measurements, wherein said constant volume behavior is determined by the pressure and time measurements satisfying the equation:

$$dV = -CV\,dP$$

where
C = fluid compressibility
V = system flow-back or wellbore volume
dV = change in volume corresponding to a change in pressure
dP = change in pressure corresponding to a change in volume.

2. A method of determining characteristics of a fracture subterranean formation comprising the steps of:
   (a) injecting fluid into a wellbore penetrating said subterranean formation to generate a fracture in said formation;
   (b) measuring pressure of the fluid over time after injection of said fluid has ceased; and
   (c) determining fracture volume of said fracture by subtracting wellbore volume from apparent system volume at the cessation of fluid injection wherein said apparent system volume is determined by the equation:

$$-\frac{1}{C}\ \frac{\frac{dV}{dt}}{\frac{dP}{dt}} = V$$

or $$-\frac{1}{C}\ \frac{dV}{dP} = V$$

wherein
C=fluid compressibility
V=apparent system volume
dV/dt=flow rate or rate of change of volume with respect to time
dP/dt=rate of change of pressure with respect to time
dV/dP=rate of change of system volume respect to pressure.

3. The method of claim 2 wherein said fracture volume and leak-off volume and efficiency are determined by iterating with a fluid volume equation:

$$V_f = V_{fB} + V_{LO} - V_{fE}$$

wherein
$V_f$=fracture volume at beginning of flow-back
$V_{fB}$=total flow-back volume
$V_{LO}$=total fluid leaked into formation
$V_{fE}$=fluid expansion during flow-back.

4. A method of determining characteristics of a fractured subterranean formation comprising the steps of:
(a) injecting fluid into a wellbore penetrating said subterranean formation to generate a fracture in said formation;
(b) measuring pressure of the fluid over time after injection of said fluid has ceased whereby apparent system volume can be determined; and
(c) determining fracture volume of said fractured formation by integrating fracture closure rate over time, wherein the rate of fracture closure is determined by the equation:

$$q_{fc} = 1 - \left(\frac{V_w}{V}\right) q_{fb}$$

wherein
$q_{fc}$=rate of fracture closure
$V_w$=wellbore volume
V=apparent system volume
$q_{fb}$=system flow-back rate.

5. The method of claim 4 wherein the fracture volume, leak-off volume and efficiency are determined by iterating with a fluid volume equation:

$$V_f = V_{fB} + V_{LO} - V_{fE}$$

wherein
$V_f$=fracture volume at beginning of flow-back
$V_{fB}$=total flow-back volume
$V_{LO}$=total fluid leaked into formation
$V_{fE}$=fluid expansion during flow-back.

6. A method of determining characteristics of a fractured subterranean formation comprising the steps of:
(a) injecting fluid into a wellbore penetrating said subterranean formation to generate a fracture in said formation;
(b) measuring pressure of the fluid over time after injection of said fluid has ceased;
(c) determining fracture closure pressure at onset of constant volume behavior of said pressure and time measurements, said constant volume behavior being determined by said pressure and time measurements satisfying the equation:

$$dV = -CV\,dP$$

wherein
C=fluid compressibility
V=system flow-back or wellbore volume
dV=change in volume corresponding to a change in pressure
dP=change in pressure corresponding to a change in volume
(d) determining fracture volume of said fractured formation from said pressure and time data.

7. The method of claim 6 wherein the fracture volume is determined by integrating the rate of fracture closure over time, said rate of fracture closure being determined by the equation:

$$q_{fc} = 1 - \left(\frac{V_w}{V}\right) q_{fb}$$

wherein
$q_{fc}$=rate of fracture closure
$V_w$=wellbore volume
V=apparent system volume
$q_{fb}$=system flow-back rate.

8. The method of claim 7 wherein the fracture volume, leak-off volume and efficiency are determined by iterating with a fluid volume equation:

$$V_f = V_{fB} + V_{LO} - V_{fE}$$

wherein
$V_f$=fracture volume at beginning of flow-back
$V_{fB}$=total flow-back volume
$V_{LO}$=total fluid leaked into formation
$V_{fE}$=fluid expansion during flow-back.

9. The method of claim 6 wherein the fracture volume of said fractured formation is determined by subtracting wellbore volume from apparent system volume at the cessation of fluid injection, said apparent system volume being represented by the equation:

$$-\frac{1}{C}\ \frac{\frac{dV}{dt}}{\frac{dP}{dt}} = V$$

or $$-\frac{1}{C}\ \frac{dV}{dP} = V$$

wherein
C=fluid compressibility
V=apparent system volume
dV/dt=flow rate or rate of change of volume with respect to time
dP/dt=rate of change of pressure with respect to time
dV/dP=rate of change of system volume with respect to pressure.

10. The method of claim 9 wherein the fracture volume, leak-off volume and efficiency are determined by iterating with a fluid volume equation:

$$V_f = V_{fB} + V_{LO} - V_{fE}$$

wherein $V_f$ = fracture volume at beginning of flow-back $V_{fB}$ = total flow-back volume $V_{LO}$ = total fluid leaked into formation $V_{fE}$ = fluid expansion during flow-back.

* * * * *